US006439120B1

(12) United States Patent
Bureaux et al.

(10) Patent No.: US 6,439,120 B1
(45) Date of Patent: Aug. 27, 2002

(54) APPARATUS AND METHOD FOR BLAST SUPPRESSION

(75) Inventors: John G. Bureaux, Orleans; George Cowan, deceased, late of Burnstown, by Joan Cowan, representative; Patricia Mountain, Fort Erie; Douglas Eaton, Ottawa; Christopher Corbin, St. Catharines, all of (CA)

(73) Assignee: Her Majesty the Queen in right of Canada as represented by the Solicitor General Acting Through the Commissioner of Royal Canadian Mounted Police, Ottawa (CA)

( * ) Notice: Subject to any disclaimer, the term of this patent is extended or adjusted under 35 U.S.C. 154(b) by 0 days.

(21) Appl. No.: 09/581,085

(22) PCT Filed: Dec. 11, 1998

(86) PCT No.: PCT/CA98/01163

§ 371 (c)(1),
(2), (4) Date: Feb. 5, 2001

(87) PCT Pub. No.: WO99/31457

PCT Pub. Date: Jun. 24, 1999

Related U.S. Application Data

(60) Provisional application No. 60/069,533, filed on Dec. 12, 1997.

(51) Int. Cl.[7] ..... F42D 5/05
(52) U.S. Cl. ..... 102/303; 86/50
(58) Field of Search ..... 102/303; 86/50

(56) References Cited

U.S. PATENT DOCUMENTS 3,814,016 A * 6/1974 Leach et al. ..... 102/22
4,392,412 A * 7/1983 Schmidt et al. ..... 89/14 D
4,543,872 A * 10/1985 Graham et al. ..... 86/1 B
4,589,341 A * 5/1986 Clark et al. ..... 102/303
4,628,819 A * 12/1986 Backofen, Jr. et al. . 102/303 X
4,889,258 A * 12/1989 Yerushalmi ..... 102/303 X
4,964,329 A * 10/1990 Moxon et al. ..... 86/50
5,044,252 A * 9/1991 Gamadi et al. ..... 86/50
5,060,314 A * 10/1991 Lewis ..... 2/2.5
5,076,168 A * 12/1991 Yoshida et al. ..... 102/303
5,375,528 A * 12/1994 Brinkman et al. ..... 102/302 X
5,471,906 A * 12/1995 Bachner, Jr. et al. ..... 89/36.05
5,576,511 A * 11/1996 Alhamad ..... 102/302 X
5,900,578 A * 5/1999 Wathen ..... 102/302 X
6,289,816 B1 * 9/2001 Keenan et al. ..... 102/303
6,302,026 B1 * 10/2001 Parkes ..... 102/303

FOREIGN PATENT DOCUMENTS

EP 725260 * 1/1996
WO WO 98/56465 * 12/1998

* cited by examiner

*Primary Examiner*—Peter A. Nelson
(74) *Attorney, Agent, or Firm*—Freedman & Associates

(57) ABSTRACT

The invention disclosed is an apparatus for explosive blast suppression, and a method therefor, the apparatus comprising a hemispherical enclosure (10) defined by an upstanding wall, positioning means (42) associated with the enclosure, for positioning the explosive device substantially equidistant from any point on the wall, and in a preferred embodiment includes an integral floor (40) and a rounded lower wall, to provide a substantially even distribution of blast forces in all directions toward the wall. The enclosure is made of composite textile material, comprising one or several layers of a ballistic material (e.g. Dyneema Kevlar) sandwiched between inner and outer layers of a light-weight rip-stop nylon fabric material.

21 Claims, 2 Drawing Sheets

APPARATUS AND METHOD FOR BLAST SUPPRESSION

This application claims the benefit of provisional application 60/069,533 filed Dec. 12, 1997.

BACKGROUND OF THE INVENTION

This invention relates to explosive blast suppression, and to an apparatus and method for use therefor.

DESCRIPTION OF THE PRIOR ART

The use of aqueous foam enclosed in various barrier structures has been employed in the prior art with mixed success. Two related relevant references are, U.S. Pat. Nos. 5,225,622 and 5,394,786. Both references describe a foam-filled enclosure for explosive blast suppression. FIG. 10 of the first patent illustrates a dome-shaped enclosure. It is noted that the diameter of the dome and hence the volume of the enclosure is quite large, i.e. of the order of 12 ft. and is thus inefficient and unnecessarily bulky. Moreover the foam expansion ratio is quite high i.e. 135–1000:1. This causes instability and early breakdown of the foam.

SUMMARY OF THE INVENTION

When a blast occurs under aqueous foam, as each bubble bursts, there is an incremental loss of the blast overpressure energy, the net effect of millions of bubbles being destroyed represents a significant blast reduction. Working from the premise that the suppressant quality of the foam would be a function of the mechanical generation and strength of the bubble we have found that superior blast suppression can be achieved by significantly reducing the size of the dome shaped enclosure and the amount of foam material, and by employing a selected aqueous high stability flowable foam material having a low expansion ratio, and low drainage rate properties.

According to one aspect of the invention, an apparatus is provided for suppression of a blast from an explosive device, comprising a) a hemispherical enclosure defined by an upstanding wall, b) positioning means associated with the enclosure, for positioning the explosive device within the enclosure substantially equidistant from any point on the wall, and c) an opening in the wall for receiving an aqueous flowable energy absorbing foam material, having an expansion ratio of 17–49:1, substantially filling said enclosure and covering the device, whereby upon detonation of the explosive device so positioned, the blast is suppressed.

According to another aspect of the invention, a method is provided for suppression of a blast from an explosive device, comprising a) providing a hemispherical enclosure defined by an upstanding wall, b) positioning the explosive device within the enclosure, substantially equidistant from any point on the wall, and c) substantially filling the enclosure and covering the device, with an aqueous energy absorbing flowable foam material having an expansion ratio of 17–49:1, and whereby upon detonation of the device so positioned, the blast is suppressed.

DESCRIPTION OF THE PREFERRED EMBODIMENTS

Figure 1:
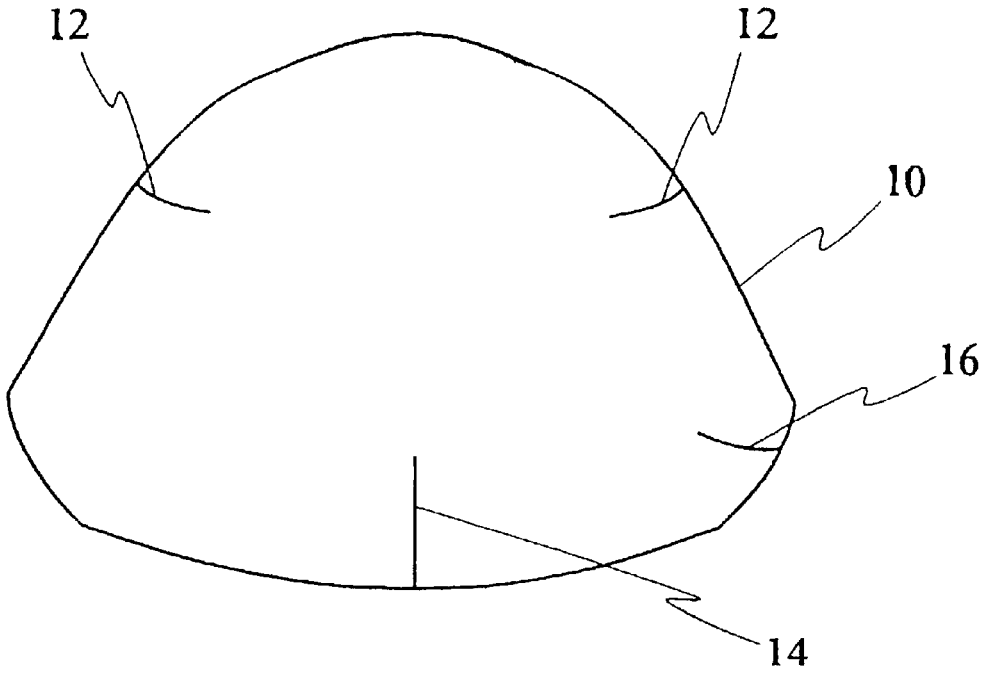
FIG. 1 is a perspective view of a hemispherical enclosure according to the invention.
Figure 2:
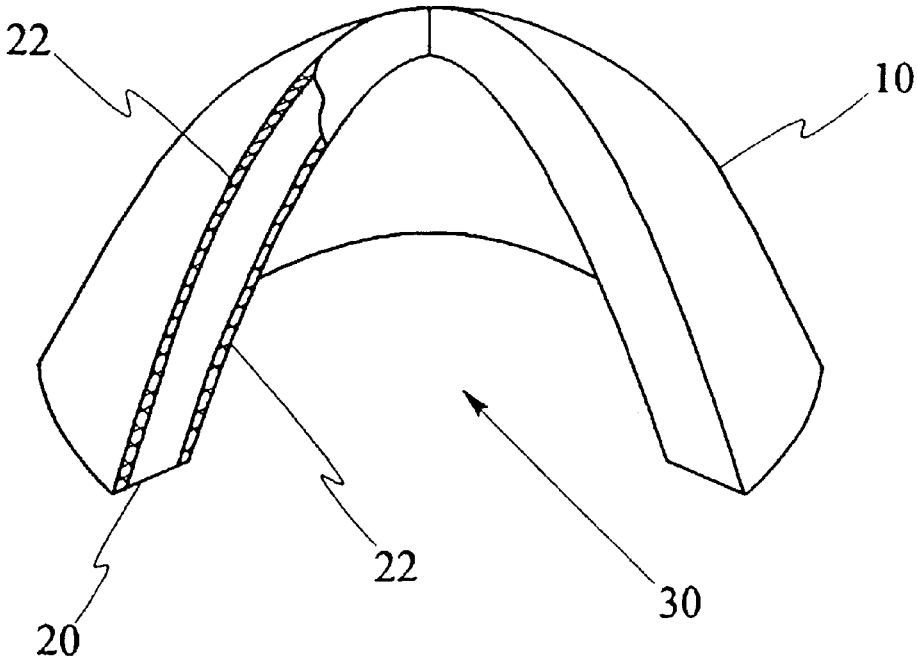
FIG. 2 is a perspective view of a hemispherical enclosure according to the invention, cut away in part to illustrate the cross-section of the composite material from which it is constructed.

As seen in FIGS. 1 and 2, the hemispherical enclosure 10 is defined by an upstanding wall, and as having a diameter of 5–9 ft. It will be appreciated that other enclosure sizes, particularly smaller sizes, are within the scope of this invention.

Foam injection openings 12 are provided near the top of the enclosure, and a door opening 14 is provided at the base. An optional opening 16 is provided near the base for foam injection, or to remove noxious gases resulting from a low energy device when no foam is used. For such cases a filter/pump device could be used. All of the openings include a sealing flap (FIG. 3) and the opening 16 includes a zipper or other suitable closure means, to prevent foam leakage and escape of shrapnel or noxious gases.

As seen in FIG. 2, the enclosure 10 is made of a composite textile material, including a central layer 20 of a ballistic fabric material (one such material is sold under the trademark Dyneema), sandwiched between inner and outer layers 22 of a light-weight rip-stop nylon fabric material. Other useful ballistic materials include Kevlar™ or equivalents. The materials are sewn together in sections. In some embodiments this layer can be eliminated ort several layers of the ballistic fabric material are provided ie. depending upon the threat to be addressed. Weight is also a consideration. For example, a 7 foot diameter enclosure with three ballistic layers weights 30 pounds, which is the practical limit for a man dressed in a bulky bomb suit to carry any appreciable distance. A five foolt enclosure with four ballistic layers would also met this criterion.

In some cases, instead of the extra ballistic layers, a hemispherical fly (not shown) is added as an overlay to enclose the structure. The fly is made of the same multi-ply textile material as the enclosure. Additional flys can be added, depending on the nature/energy of the explosive device, to ensure containment of the resulting shrapnel. The extra ballistic layers are preferred, since the flys add to setup time and effort.

Figure 3:
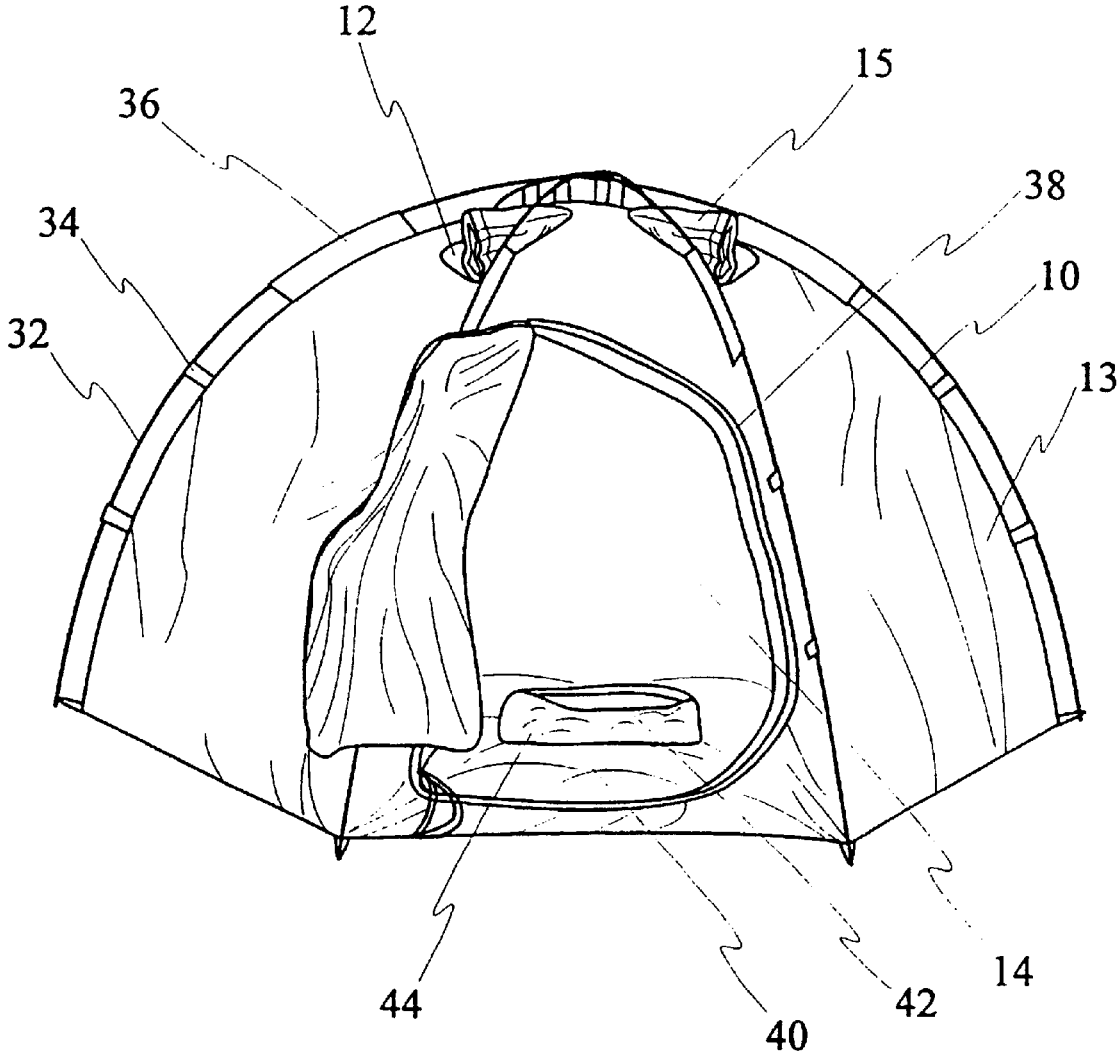
FIG. 3 is a perspective view of an apparatus according to the invention.

FIG. 3 illustrates an embodiment of the apparatus which employs a flexible external frame 32, which will flex to pass through openings, such as doorways, which are made smaller than its diameter.

In the embodiment shown, the frame 32 includes three semicircular hoop-like pole members which are disposed in a criss-cross manner and spaced equidistant from each other to form the frame. This arrangement facilitates the positioning of the apparatus without modification, by a robot arm or the like. The poles are made of fibreglass to avoid shrapnel formation, but could be made of other flexible light-weight material or could be integral air tubes.

The enclosure is made of a composite textile material similar to that of the FIG. 1 embodiment, the difference being that the inner and outer layers are of a waterproof nylon textile material.

The outer layer of the enclosure 10 includes a plurality of tab portions 34 for attachment to the frame 32. Wider tabs 36 are provided adjacent the top for added strength at this location. Although the tabs are formed as loops in the embodiment shown, it will be appreciated that other known attachment means could be used. In this embodiment the enclosure 10, includes six identical triangular panels 13, and an integral hexagonal floor 40 which approximates a circle. Foam injection openings 12 are provided in alternate panels. Closure flaps 15 of the same composite material as the panels are also provided. The flaps are secured e.g. by Velcro® fasteners. The floor 40 includes positioning means in the form of a central opening 42 for positioning an explosive device, substantially equidistant from any point on the enclosure wall. The integral floor ensures that there are no week spots or corners, which have been known in the prior art to fail.

Also in this embodiment, the door opening 14 is provided in one of the panels, and includes a large zipper closure means to facilitate operation by gloved hands.

Upon filling with foam the enclosure inflates to form a hemispherical shape, with the explosive device positioned substantially equidistant from any point on the enclosure wall. The enclosure wall is rounded adjacent to the floor, having a flattening effect on the enclosure shape. This positioning and rounded enclosure wall provide for optimum distribution of the blast force in all directions toward the enclosure wall, providing for the successful integration of various blast scenarios, as described below.

In fact, the combination of these two features has proven capable of withstanding around twice the explosive force, as compared to the FIG. 1 embodiment. See tests #3 and 4.

The method according to the invention comprises placing the enclosure 10 over an improvised explosive device (IED) at 30, and the enclosure is filled with a suitable aqueous energy absorbing, flowable foam material (e.g. Silvex®). See U.S. Pat. No. 4,770,794 of Sep. 13, 1988, the disclosure of which is incorporated herein by reference. Useful foams comprise 1–5%/w of active foam forming ingredients. We have found that a particularly useful foam material of this nature comprises 1–3%/w of active foam forming ingredients, the balance being water, and has an expansion ratio of 17–49:1. Such foams exhibit good stability and drainage properties and can be used in relatively small amounts as indicated in the Examples which follow. The foam is introduced into the enclosure at a flow rate of 40–80 US gallons/minute, preferably 40–60 US gallons/minute though filling port 12, using a standard foam generating fire truck, or a portable pump and foam generating system. The flow rate is expressed as flow rate of water into a foam generator. The flow of foam into the enclosure is actually about 2–3 times faster, because of the larger volume of the foam. When the IED is detonated, none of the resulting IED fragments penetrate the enclosure. Apparently, the lines of force from the explosion are directed radially outwardly from the IED and the force or energy from the blast is absorbed by the surrounding foam. The smooth concave shape of the enclosure which acts as a mold for the foam, and/or the corresponding convex shape of the foam also plays a role, since other configurations tested such as cubes, rectangles and cylinders fail at the corners.

Other inessential features include the following.

The provision of an integral tent floor(FIG. 3) with a central IED receiving opening would prevent the foam from flowing out around the bottom. Preferably, the fabric surrounding the central opening is made more flexible by the inclusion of an elasticized retainer which forms oversized gores 44. This minimizes blast damage to the floor. In another embodiment (not shown) the floor would be made of a net material.

An internal frame(not shown) or an external exoskeleton (FIG. 3) could be included to facilitate erection and maintain the structural integrity of the dome following the explosion. It will be appreciated that the dome can be erected by filling with the foam.

EXAMPLES

For the explosive device tested, not only is the blast suppressed, but the shrapnel from the blast is contained within the structure.

Testing of the Explosive Device Containment System

This Explosive Device Containment system is a 7 ft hemispherical shaped enclosure filled with foam (approx. 570 cubic feet). The enclosure is fabricated with a 3 layer textile composite. The outside and inside layers are a light rip-stop nylon and the inside layer is a ballistic product called DYNEEMA®. Depending upon the threat, additional ballistic layers and/or flys are provided, as described above. The foam is generated using an air aspirating foam nozzle (cylindrical, length=25 cm, diameter=15 cm) with an expansion ratio of about 25:1 with an operating pressure of about 70 PSI and a flow rate of 57–60 US gallons of foam solution/minute. The foam concentrate. comprises about 1.7%/w Silvex® in water. The nozzle is the subject of our co-pending U.S. application, Ser. No. 08/758,075, filed Nov. 27, 1996.

Test Objective

To establish the explosive blast and explosive fragment mitigation qualities of the Explosive Device Containment System.

Test #s 1 and 2 were done with the FIGS. 1,2 embodiment, and tests #s 3 and 4 with the FIG. 3 embodiment. Also, in test #3, the composite included five ballistic layers. In test #4, two additional flys were included.

Test #1

Explosive Device

Pipe bomb constructed of a 12"×2½" diameter steel pipe with end caps threaded on both ends containing approximately 1.5 lbs. of dynamite initiated by a standard electric blasting cap. The multi layer composite, plus two additional flys, is used in this test.

Results

After the pipe bomb was functioned none of the pipe fragments were found to have penetrated the enclosure. This was very significant as it confirmed this technique was effective in containing a very energetic explosive device, the fragments form the type of explosive device can be projected at velocities in the order of 5000–7000 feet/sec. and up to 200 to 300 yards.

Test #2

Explosive Device

Steel tool box (approx. 18"×10"×8") containing 2.2 lbs. of C-4 explosive initiated by a 0.2 lbs. Initiation charge. The five layer composite is used in this test.

Results

After the device was functioned an examination of the enclosure revealed that all fragmentation form this device was contained in the system. This is quite significant as it confirms that this system is very effective in neutralizing the very energetic effects of large and destructive explosive devices.

Test #3

Explosive Device

Pipe bomb constructed of a 12"×2½" diameter steel pipe with end caps threaded on both ends containing approximately 1.5 lbs. of dynamite initiated by a standard electric blasting cap. The multi layer composite, plus two additional flys, is used in this test.

Results

After the pipe bomb was functioned none of the pipe fragments were found to have penetrated the enclosure. This was very significant as it confirmed this technique was effective in containing a very energetic explosive device, the fragments form the type of explosive device can be projected at velocities in the order. of 5000–7000 feet/sec. and up to 200 to 300 yards.

Test #4

Explosive Device

Steel tool box (approx. 18"×10"×8") containing 2.2 lb. of C-4 explosive initiated by a 0.2 lbs initiation charge. A five layer composite is used in this test.

Results

After the device was functioned an examination of the enclosure revealed that all fragmentation form this device was contained in the system. This is quite significant as it confirms that this system is very effective in neutralizing the very energetic effects of large and destructive explosive devices.

General Comments

Both these devices represent examples of very energetic explosive devices. These devices can result in the projection of high velocity fragments causing considerable injuries and property damage. This system could be used by both police and military Explosive Ordnance Units. It is a portable system that can be positioned in a very short time.

Although Silvex has been used to illustrate the operation of our invention, it will be appreciated by those skilled in the art that many other foam materials may also be used, including those containing biological/chemical decontaminating agents, provided that they are formulated to exhibit the requisite expansion ratio and other related properties discussed above.

We claim:

1. An apparatus for suppression of a blast from an explosive device, comprising a) a hemispherical enclosure defined by an upstanding wall, b) positioning means associated with the enclosure for positioning the explosive device within the enclosure substantially equidistant from any point on the wall, c) an opening in the wall, and d) an aqueous energy absorbing flowable foam material having an expansion ratio of 17–49:1, substantially filling the enclosure and covering the explosive device, whereby upon detonation of the explosive device so positioned, the blast is suppressed.

2. Apparatus according to claim 1, wherein the enclosure is inflatable, whereby upon filling the enclosure is inflated by the foam.

3. Apparatus according to claim 1, wherein the enclosure includes an integral floor, and wherein the positioning means comprises a central opening in the floor.

4. Apparatus according to claim 1, wherein the diameter of the enclosure is about 5–9 feet.

5. Apparatus according to claim 1, wherein the volume of the enclosure is about 570 $ft^3$.

6. Apparatus according to claim 1, wherein the foam material comprises 1–5% w/v of active foam forming ingredients, the balance being water.

7. Apparatus according to claim 6, wherein the expansion ratio of the foam material is about 25:1.

8. Apparatus according to claim 7, wherein the foam material comprises 1.7% w/v of active foam forming ingredients, the balance being water.

9. Apparatus according to claim 1, wherein the enclosure is made of a composite textile material, comprising a layer of a ballistic fabric material, sandwiched between inner and outer layers of a light-weight rip-stop nylon fabric material.

10. Apparatus according to claim 1, wherein the enclosure is made of a composite textile material, comprising several layers of a ballistic fabric material, sandwiched between inner and outer layers of a light-weight rip-stop nylon fabric material.

11. A method for suppression of a blast from an explosive device, comprising a) providing a hemispherical enclosure defined by an upstanding wall, b) positioning the explosive device within the enclosure, substantially equidistant from any point on the wall, and c) substantially filling the enclosure and covering the device with an aqueous energy absorbing flowable foam material having an expansion ratio of 17–49:1, whereby upon detonation of the device so positioned, the blast is suppressed.

12. A method according to claim 11, wherein the enclosure is inflatable, whereby upon filling the enclosure is inflated with the foam.

13. A method according to claim 11, wherein the enclosure includes an integral floor with a central opening, and wherein the explosive device is positioned in said opening.

14. A method according to claim 13, wherein the foam material comprises 1–5% w/v of active foam forming ingredients, the balance being water.

15. A method according to claim 14, wherein the expansion ratio of the foam material is about 25:1.

16. A method according to claim 15, wherein the foam material comprises about 1.7% w/v of active foam forming ingredients, the balance being water.

17. A method according to claim 11, wherein the enclosure is made of a composite textile material comprising a layer of a ballistic fabric material, sandwiched between outer and inner layers of a waterproof nylon fabric material.

18. A method according to claim 11, wherein the enclosure is made of a composite textile material comprising several layers of a ballistic fabric material, sandwiched between inner and outer layers of a waterproof nylon fabric material.

19. An apparatus according to claim 3, wherein the enclosure is inflatable and wherein upon inflation the enclosure wall is rounded adjacent to the integral floor.

20. A method according to claim 13, wherein the enclosure is inflatable, and wherein upon inflation the enclosure wall is rounded adjacent to the integral floor.

21. An apparatus according to any one of claims 1–10 and 19, further comprising a flexible frame to support the enclosure during positioning and use.

* * * * *